US006286446B1

(12) United States Patent
Lee

(10) Patent No.: US 6,286,446 B1
(45) Date of Patent: Sep. 11, 2001

(54) MULTI-NEEDLE ZIPPER TAPE STITCHING MECHANISM, CHAIN AND ZIPPER TAPE FASTENING STRUCTURE

(76) Inventor: Jack Lee, No. 111, Kung II Road, Lung Tan Hsiang, Tao Yuan Hsien (TW)

( * ) Notice: Subject to any disclaimer, the term of this patent is extended or adjusted under 35 U.S.C. 154(b) by 0 days.

(21) Appl. No.: 09/576,609

(22) Filed: May 24, 2000

(51) Int. Cl.[7] ..... D05B 03/12
(52) U.S. Cl. ..... 112/470.33
(58) Field of Search ..... 112/470.33, 163, 112/165, 475.16, 152

(56) References Cited

U.S. PATENT DOCUMENTS 2,858,592 * 11/1958 Schwartz ..... 112/475.16 X
3,057,031 * 10/1962 Wahl ..... 112/475.16 X
3,316,870 * 5/1967 Burbank ..... 112/475.16
3,685,474 * 8/1972 Frohlich et al. ..... 112/475.16 X
3,750,605 * 8/1973 Warburton et al. ..... 112/475.16
3,755,879 * 9/1973 Cuckson ..... 112/475.16
4,441,438 * 4/1984 Takahashi ..... 112/470.33

* cited by examiner

*Primary Examiner*—Ismael Izaguirre
(74) *Attorney, Agent, or Firm*—Rosenberg, Klein & Lee

(57) ABSTRACT

A multi-needle zipper tape stitching mechanism includes a bottom needle plate having two parallel guide grooves for the passing of two chains (rows of teeth, a guide plate with two needle holes mounted on the bottom needle plate, a guide bar for guiding two zipper tapes over the chains being delivered through the bottom needle plate, an upper needle plate covered on the bottom needle plate and defining with the bottom needle plate two zipper tape passage ways for the passing of the zipper tapes and the chains, and two stitching needles reciprocated through respective needle holes on the upper needle plate and the needle holes on the guide plate to fasten the chains to the zipper tapes with three lines of stitches respectively, the stitching needles each having three needle rods arranged in parallel and spaced from one another at a different pitch, the needle rods each having a point and an eye on the point for the insertion of a respective thread.

3 Claims, 9 Drawing Sheets

MULTI-NEEDLE ZIPPER TAPE STITCHING MECHANISM, CHAIN AND ZIPPER TAPE FASTENING STRUCTURE

BACKGROUND OF THE INVENTION

The present invention relates to a zipper tape stitching mechanism for the fabrication of zippers, and more particularly to a multi-needle zipper tape stitching mechanism, which fastens two chains (rows of teeth) to two zipper tapes with three parallel lines of stitches respectively.

A regular zipper, as shown in FIGS. 1 and 2, is generally comprised of two zipper tapes 20', two chains (rows of teeth) 10' respectively fastened to the zipper tapes 20' with two parallel lines of stitches 32' and 34', and two core members 14' respectively mounted in the chains 10'. Because of the use of the core members in the chains, the fabrication of this structure of zipper is complicated, and its manufacturing cost is high. Further, when sliding the slide to close/open the zipper, the chains are stretched, and the lines of stitches tend to be broken.

SUMMARY OF THE INVENTION

It is one object of the present invention to provide a multi-needle zipper tape stitching mechanism, which fastens a chain (row of teeth) to a zipper tape with three parallel lines of stitches. It is another object of the present invention to provide a multi-needle zipper tape stitching mechanism, which simplifies the fabrication of zippers, and saves the manufacturing cost of zippers. According to one aspect of the present invention, a multi-needle zipper tape stitching mechanism comprises a bottom needle plate having two parallel guide grooves for the passing of two chains (rows of teeth, a guide plate with two needle holes mounted on the bottom needle plate, a guide bar for guiding two zipper tapes over the chains being delivered through the bottom needle plate, an upper needle plate covered on the bottom needle plate and defining with the bottom needle plate two zipper tape passage ways for the passing of the zipper tapes and the chains, and two stitching needles reciprocated through respective needle holes on the upper needle plate and the needle holes on the guide plate to fasten the chains to the zipper tapes with three lines of stitches respectively. According to another aspect of the present invention, the stitching needles each have three needle rods arranged in parallel and spaced from one another at a different pitch, the needle rods each having a point and an eye on the point for the insertion of a respective thread.

DETAILED DESCRIPTION OF THE PREFERRED EMBODIMENT

Figure 1:
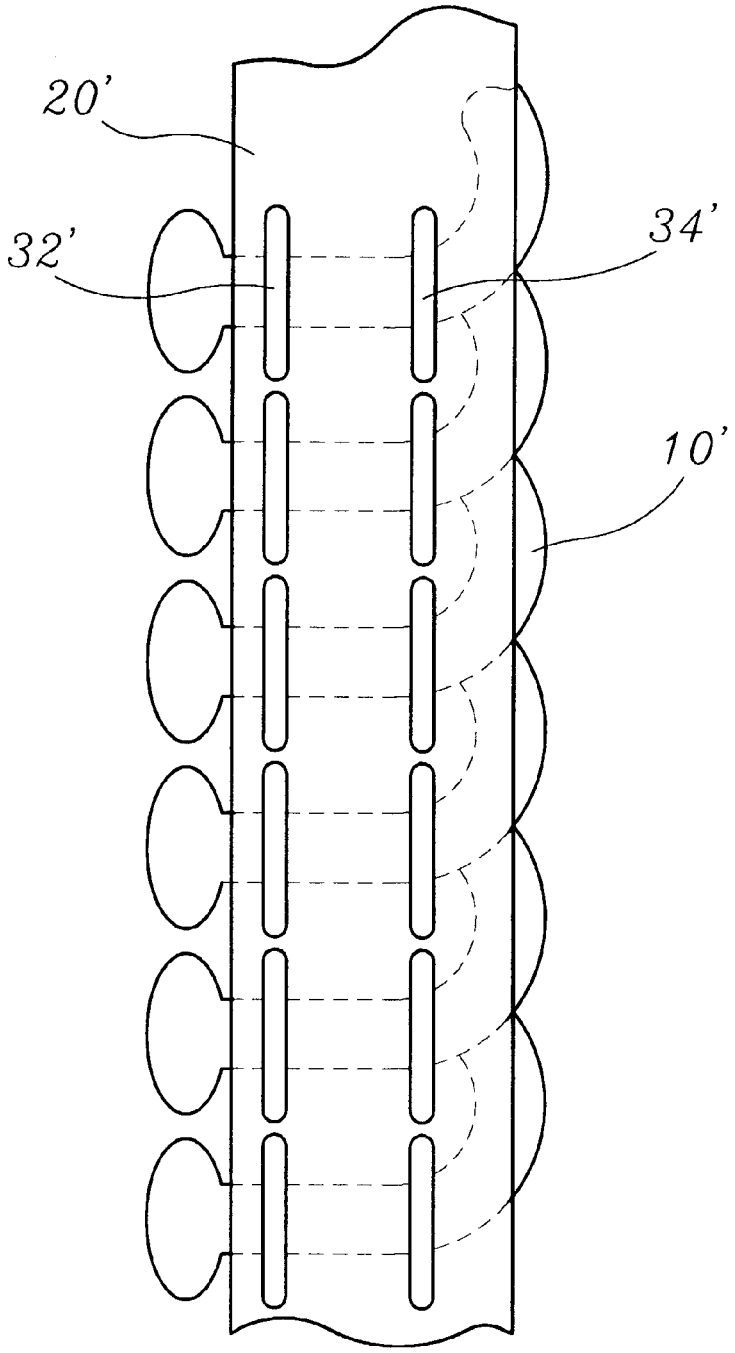
FIG. 1 (PRIOR ART)
FIG. 1 is a plain view showing a chain fastened to a zipper tape with two parallel lines of stitches according to the prior art.
Figure 2:
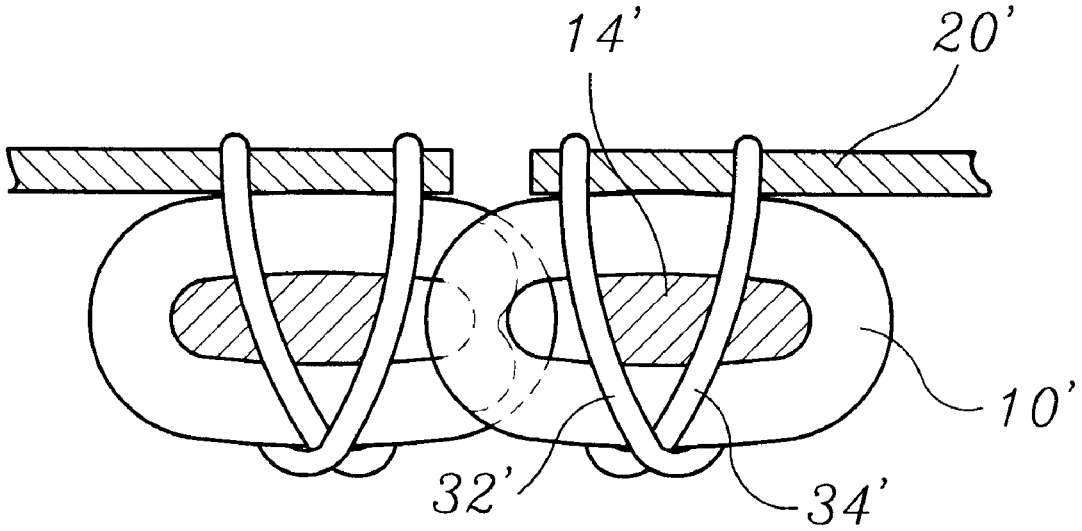
FIG.2 (PRIOR ART)
FIG. 2 is a cross sectional view showing a zipper closed according to the prior art.
Figure 3:
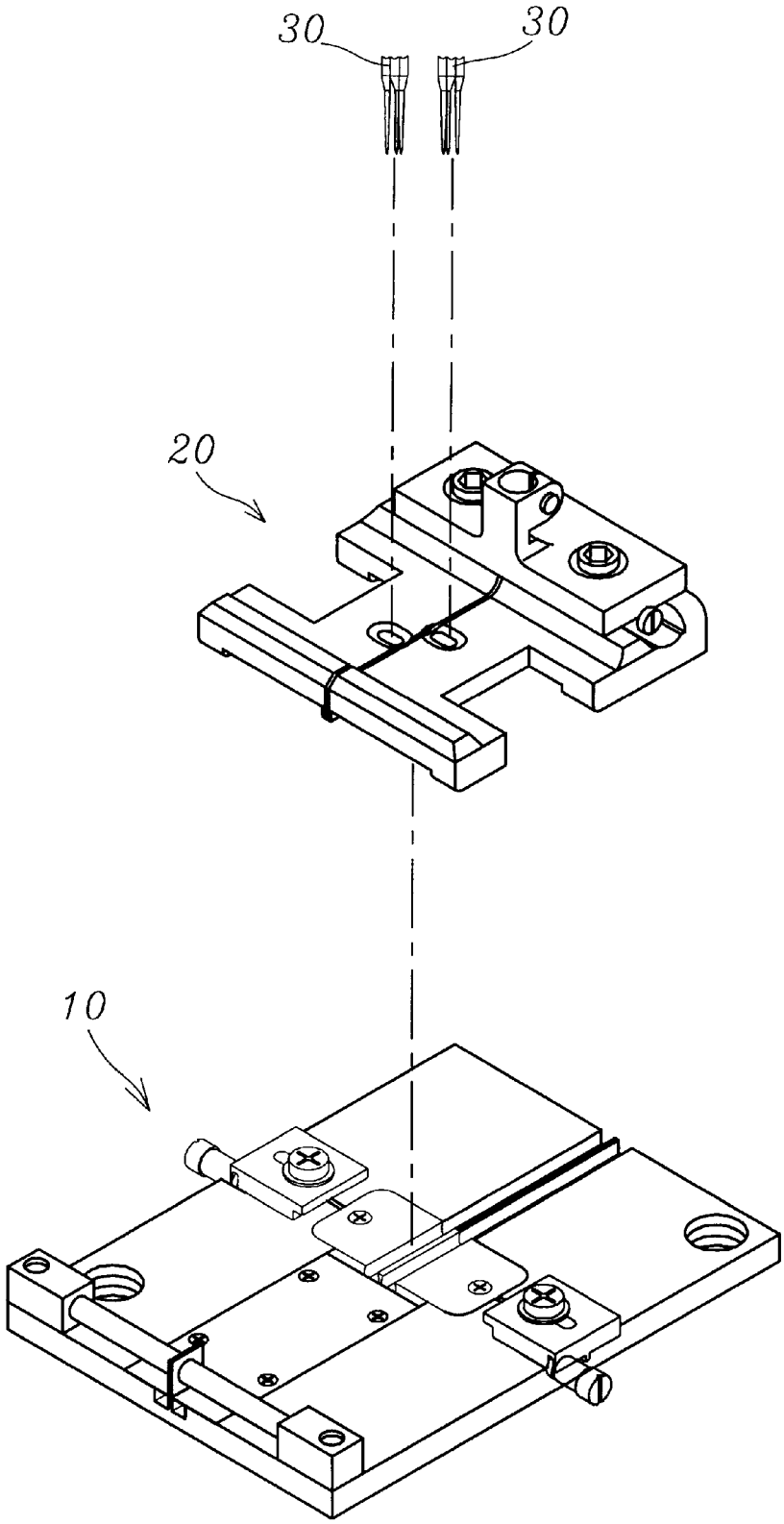
FIG. 3 is an exploded view of a multi-needle zipper tape stitching mechanism according to the present invention.
Figures 4, 4A:
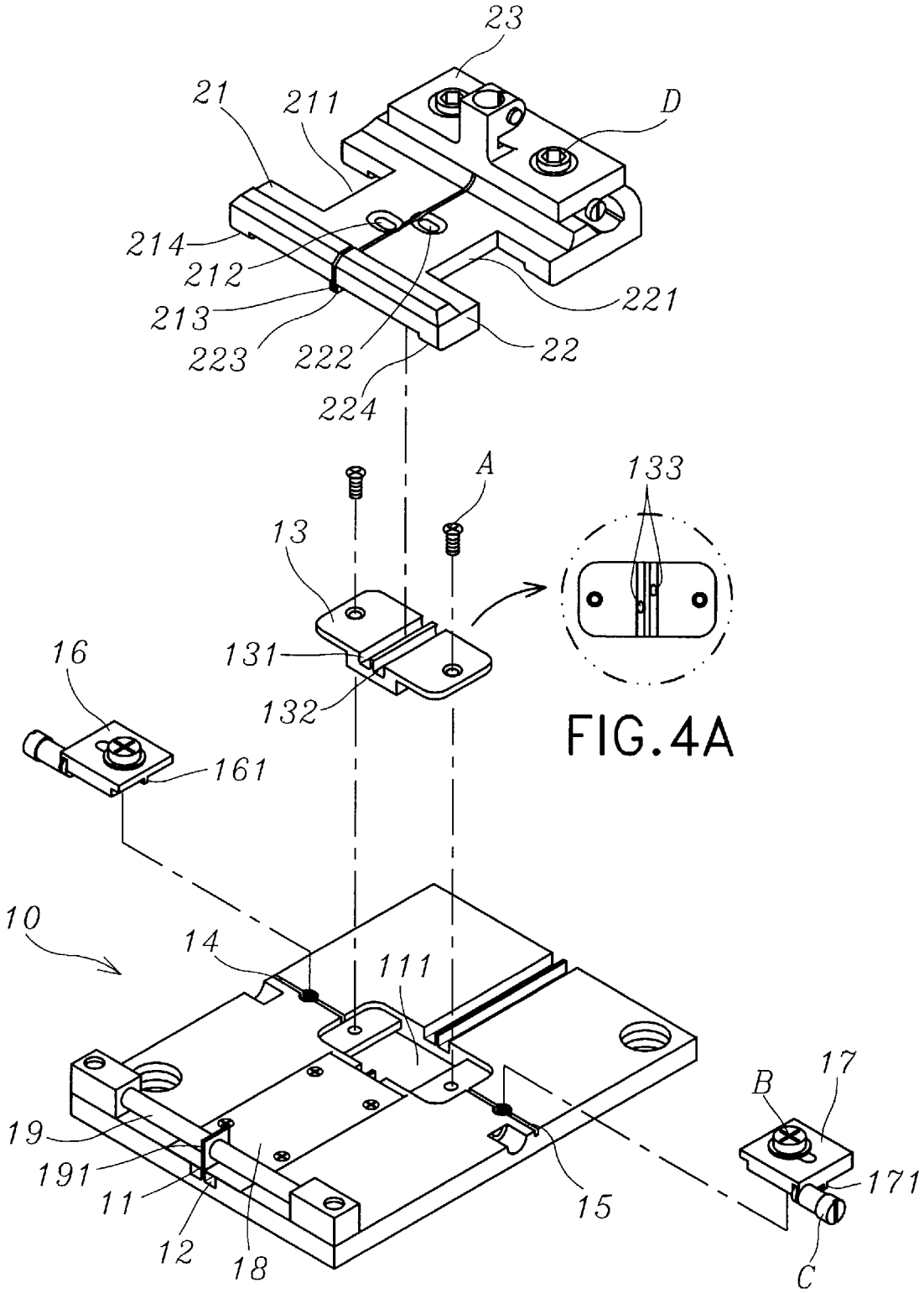
FIG. 4 is another exploded view of the present invention.
FIG. 4A is a top view of the guide plate shown in FIG. 4.
Figure 5:
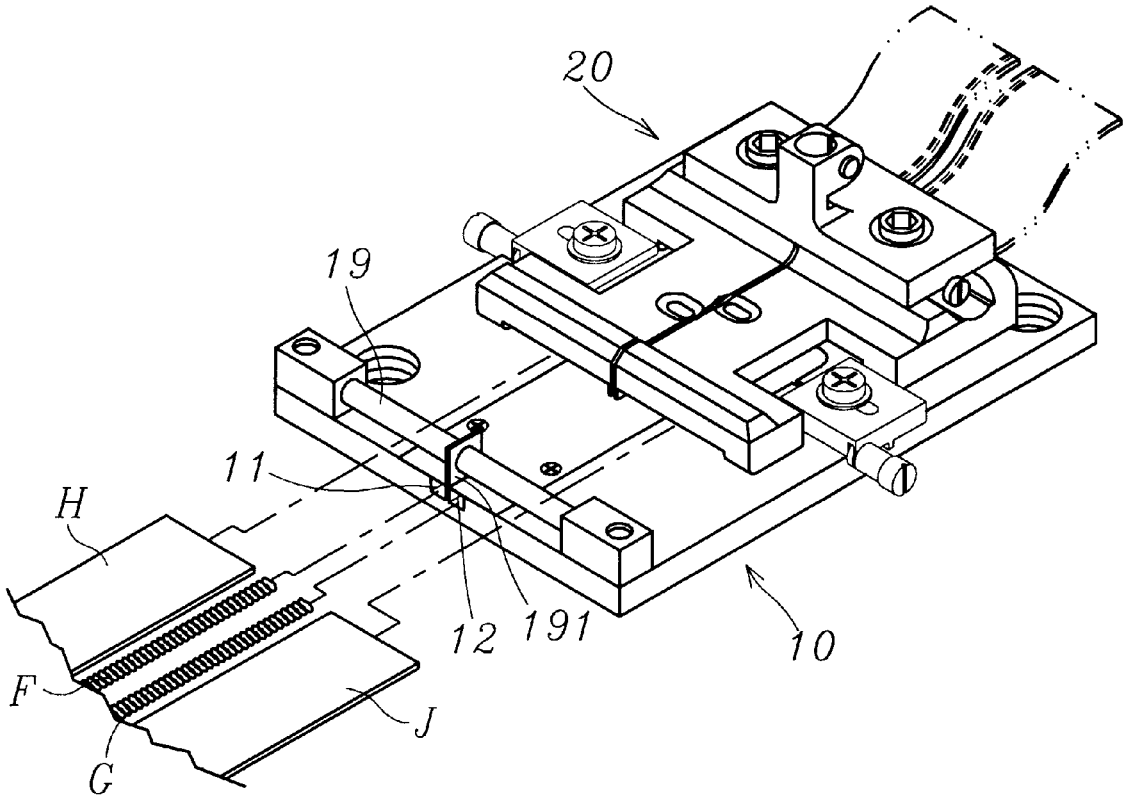
FIG. 5 shows an application example of the present invention.

Referring to FIGS. from 3 through 5, a multi-needle zipper tape stitching mechanism is shown comprised of a bottom needle plate 10, an upper needle plate 20, and two stitching needles 30. The bottom needle plate 10 comprises two parallel guide grooves 11 and 12 extended lengthwise on the middle, a rectangular opening 111 through the middle part of the guide grooves 11 and 12, and two transverse sliding grooves 14 and 15 respectively extended from two opposite sides of the rectangular opening 111. A guide plate 13 is fixedly fastened to the bottom needle plate 10 by screws A and suspended in the rectangular opening 111, comprising two parallel guide grooves 131 and 132 formed on the top side wall thereof and respectively aligned between sections of the guide grooves 11 and 12, and two needle holes 133 respectively formed in the guide grooves 131 and 132. Two presser plates 16 and 17 are respectively installed in the transverse sliding grooves 14 and 15. The presser plate 16 or 17 has a bottom rail 161 or 171 coupled to the transverse sliding groove 14 or 15. The presser plates 16 and 17 are respectively moved along the transverse sliding grooves 14 and 15 relative to the guide plate 13, and then fixed in position by respective screws B and C. A cover board 18 is covered on the bottom needle plate 10 over the guide grooves 11 and 12 in front of the guide plate 13. A transverse guide bar 19 is mounted on the bottom needle plate 10 at a front side, having a partition plate 191 vertically disposed on the middle and spaced between the guide grooves 11 and 12. The upper needle plate 20 is comprised of two symmetrical pressure plates 21 and 22 abutted against each other, and a fixing plate 23 fastened to the pressure plates 21 and 22 at the top by screws D to fix the pressure plates 21 and 22 together. The pressure plates 21 and 22 each comprise a side opening 211 or 221, which receives the presser plate 16 or 17, a needle hole 212 or 222 corresponding to one needle hole 133 on the guide plate 13, a first bottom flange 213 or 223 and a second bottom flange 214 or 224 bilaterally disposed at the front side.

Figure 8:
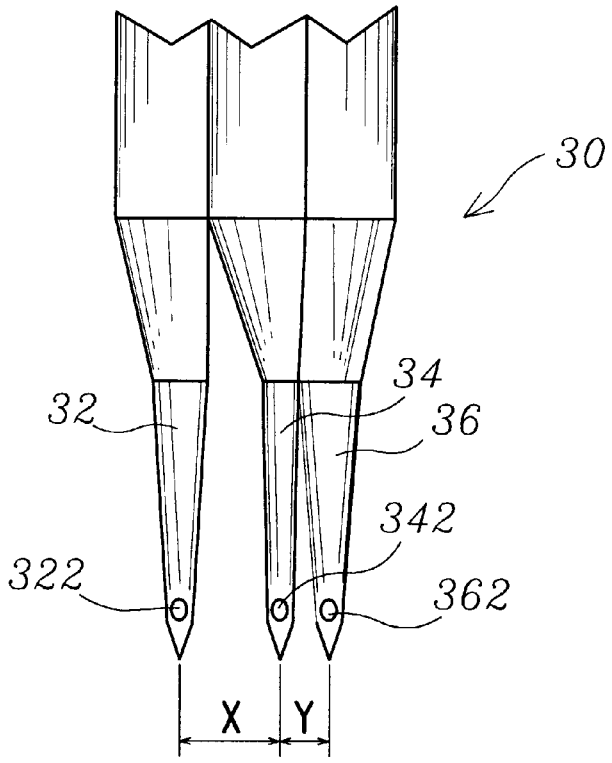
FIG. 8 is a front view of a stitching needle according to the present invention.
Figure 9:
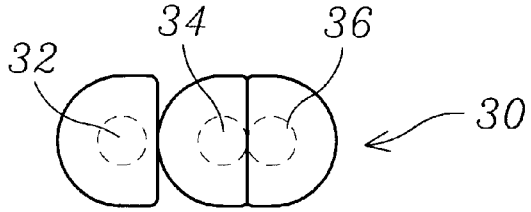
FIG. 9 is a cross sectional view of the stitching needle shown in FIG. 8.

Referring to FIGS. 8 and 9, the stitching needle 30 comprises three needle rods 32, 34, and 36 arranged in parallel, each having an eye 322, 342, or 362 on the respective point for the insertion of a respective thread. The pitch X between the eye 322 of the first needle rod 32 and the eye 342 of the second needle rod 34 and the pitch Y between the eye 342 of the first needle rod 34 and the eye 362 of the third needle rod 36 are different.

Figure 6:
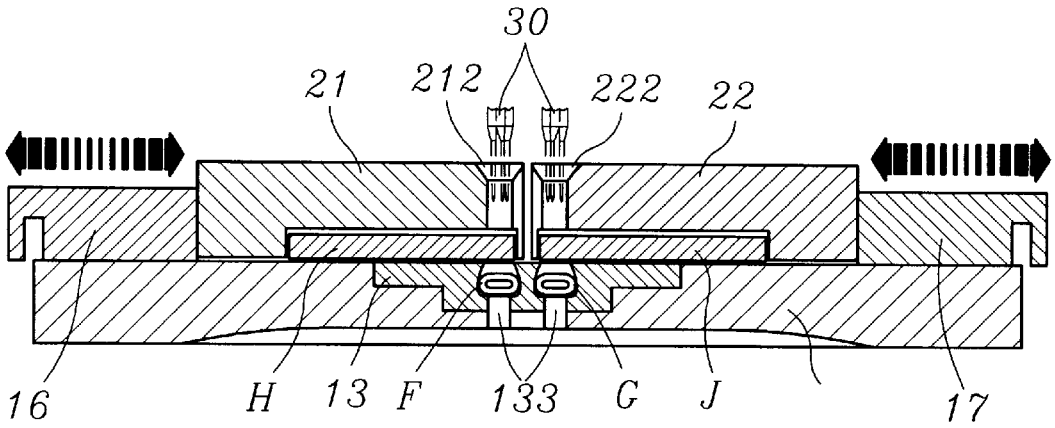
FIG. 6 is a cross sectional view of the present invention.
Figure 7A:
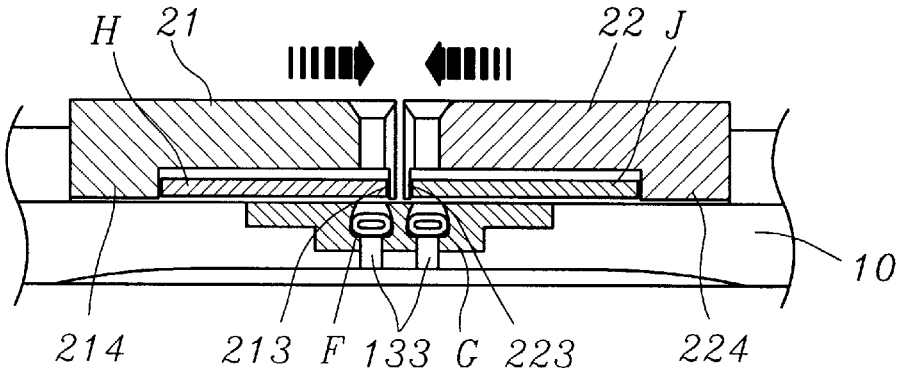
FIG. 7A is a sectional view showing the pitch between the pressure plates of the upper needle plate adjusted.
Figure 7B:
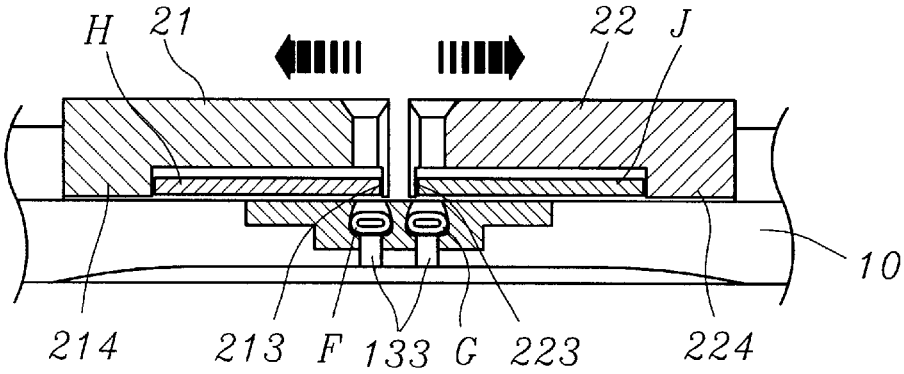
FIG. 7B is similar to FIG. 7A but showing the pitch between the pressure plates of the upper needle plate increased.

Referring to FIGS. 6, 7A and 7B, and FIG. 5 again, two chains F and G are respectively inserted into the guide grooves 11 and 12, and at the same time two zipper tapes H and J are moved over the guide bar 19 at two opposite sides of the partition plate 191 and inserted through the space between the bottom needle plate 10 and the upper needle plate 20. When passing through the space between the bottom needle plate 10 and the upper needle plate 20, the zipper tapes H and J are guided by the bottom flanges 213 and 223 of the first pressure plate 21 and the bottom flanges 223 and 224 of the second pressure plate 22 and moved below the pressure plates 21 and 22. When the screws B and C are loosened, the pressure plates 16 and 17 are moved along the sliding grooves 14 and 15 relative to each other to adjust the pitch subject to the width of the zipper tapes H and J. After adjustment, the screws B and C are fastened up, and then the needles 30 are reciprocated to pass through the needle holes 212 and 222, enabling the chains F and G to be respectively fastened to the zipper tapes H and J with stitches.

Figure 10:
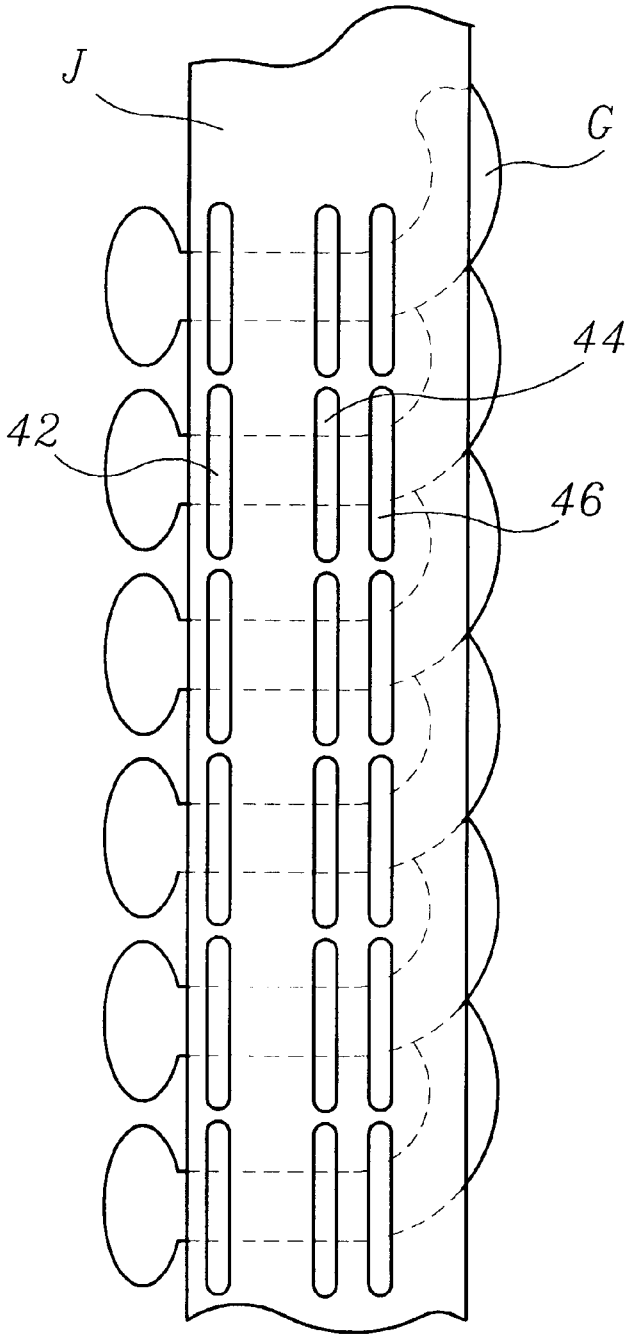
FIG. 10 is a plain view show a chain fastened to a zipper tape with three parallel lines of stitches according to the present invention.
Figure 11:
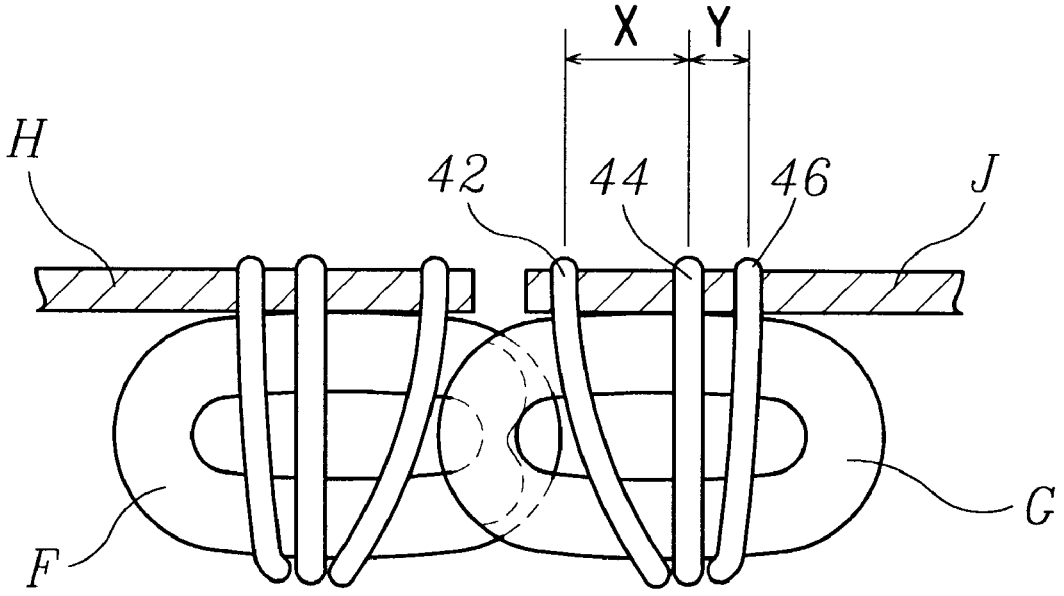
FIG. 11 is a cross sectional view showing a zipper closed according to the present invention.

Referring to FIGS. 10 and 11, a zipper according to the present invention is comprised of two zipper tapes H and J, and two chains F and G respectively fastened to the zipper tapes H and J with three parallel lines of stitches 42, 44, and 46. The three parallel lines of stitches 42, 44, and 46 are extended along the length of the respective zipper tape F or G, and the pitch between each two adjacent line of stitches is unequal. According to the present invention, the pitch X between the first line of stitches 42 and the second line of stitches 44 is greater than the pitch Y between the second line of stitches 44 and the third line of stitches 46. This design enables the protruding upper faces of the teeth of the chains F and G to be flexibly moved within a limited range, so that the chains F and G can be positively interlocked when pulling up the slide (not shown). Because the chains F and G are respectively fastened to the zipper tapes H and J with three parallel lines of stitches 42, 44, and 46, the chains F and G are firmly secured to the zipper tapes H and J against stretching force.

It is to be understood that the drawings are designed for purposes of illustration only, and are not intended for use as a definition of the limits and scope of the invention disclosed.

What the invention claimed is:

1. A multi-needle zipper tape stitching mechanism comprising:

a bottom needle plate, said bottom needle plate comprising two parallel guide grooves extended lengthwise on the middle, a rectangular opening through a middle part of said parallel guide grooves, and two transverse sliding grooves respectively extended from two opposite sides of said rectangular opening;

a guide plate fixedly fastened to said bottom needle plate by screws and suspended in said rectangular opening, said guide plate comprising two parallel guide grooves formed on a top side wall thereof and respectively coincided with the guide grooves on said bottom needle plate, and two needle holes respectively formed in the guide grooves on said guide plate;

two presser plates respectively installed in the transverse sliding grooves on said bottom needle plate, said presser plates each comprising a bottom rail respectively coupled to the transverse sliding groove on said bottom needle plate and fixed in place by screws;

a cover board covered on said bottom needle plate in front of said guide plate;

a transverse guide bar mounted on said bottom needle plate at a front side and suspended above the guide grooves on said bottom needle plate, said transverse guide bar having a partition plate vertically disposed on the middle and spaced between the guide grooves on said bottom needle plate;

an upper needle plate covered on a part of said bottom needle plate, said upper needle plate comprised of two symmetrical pressure plates, and a fixing plate fastened to said pressure plates at a top side by screws to fix said pressure plates together, said pressure plates each comprising a side opening, which receives one of said presser plates, a needle hole corresponding to one needle hole on said guide plate, and two bottom flanges bilaterally disposed at the front side and defining with said guide plate and said bottom needle plate a zipper tape passage; and two stitching needles reciprocated through the needle holes on said upper needle plate and the needle holes on said guide plate to fasten two chains to two zipper tapes with three threads respectively, said stitching needles each comprising three needle rods arranged in parallel and spaced from one another at a different pitch, said needle rods each having a point and an eye on the point for the insertion of a respective thread.

2. A zipper fastening structure, comprising:

a zipper tape, a continuous spirally shaped chain formed of a plurality of integrally coupled coils, and at least three substantially parallel lines of stitches passing through said zipper tape in intimate engagement with said coils of said spirally shaped chain for securing the same to said zipper tape, said lines of stitches being spaced at differing distances each from the other.

3. The zipper fastening structure of claim 2, further comprising:

a pair of said zipper tapes, and a pair of said spirally shaped chains, each secured to a respective one of said pair of zipper tapes, wherein each of said coils of said spirally shaped chains has a mating portion for interlocking said pair of spirally shaped chains each to the other, and wherein said at least three lines of stitches include a first line of stitches extending in proximity to said mating portions of said coils, a second line of stitches extending distantly from said first line of stitches, and a middle line of stitches extending therebetween;

the distance between said first and said middle lines of stitches being greater than the distance between said middle and said second lines of stitches.

* * * * *